US010889117B2

(12) United States Patent
Sokolowski et al.

(10) Patent No.: US 10,889,117 B2
(45) Date of Patent: Jan. 12, 2021

(54) SYSTEM AND METHOD FOR ATTENUATING THE DRYING OF INK FROM A PRINTHEAD DURING PERIODS OF PRINTER INACTIVITY

(71) Applicant: Xerox Corporation, Norwalk, CT (US)

(72) Inventors: Piotr Sokolowski, Webster, NY (US); Timothy G. Shelhart, West Henrietta, NY (US); Sean R. Keyes, Fairport, NY (US); Ana R. Fietz-Bogota, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 28 days.

(21) Appl. No.: 16/367,761

(22) Filed: Mar. 28, 2019

(65) Prior Publication Data

US 2020/0307219 A1 Oct. 1, 2020

(51) Int. Cl.
*B41J 2/165* (2006.01)
*B41J 2/045* (2006.01)
*B41J 2/175* (2006.01)

(52) U.S. Cl.
CPC ..... *B41J 2/16505* (2013.01); *B41J 2/04581* (2013.01); *B41J 2/17596* (2013.01); *B41J 2202/20* (2013.01)

(58) Field of Classification Search
CPC ..... B41J 2/16505; B41J 2/04581; B41J 2/17596; B41J 2202/20; B41J 2/165; B41J 2/16511; B41J 2/16523; B41J 2/16547; B41J 2/1753; B41J 2/17536; B41J 2/1754
See application file for complete search history.

(56) References Cited

U.S. PATENT DOCUMENTS 4,296,418 A 10/1981 Yamazaki et al.
4,364,065 A 12/1982 Yamamoh et al.
4,571,601 A 2/1986 Teshima
4,746,938 A 5/1988 Yamamori et al.
(Continued)

FOREIGN PATENT DOCUMENTS

DE 10 2011 002 727 A1 7/2012
EP 1 827 839 B1 2/2009
(Continued)

OTHER PUBLICATIONS

Kwon et al.; Measurement of inkjet first-drop behavior using a high-speed camera; Review of Scientific Instruments; Mar. 2, 2016; vol. 87—Issue No. 3; AIP Publishing.

*Primary Examiner* — Kristal Feggins
(74) *Attorney, Agent, or Firm* — Maginot Moore & Beck LLP

(57) ABSTRACT

A capping station is configured for storing printheads during printer inactivity to preserve the viscosity of the ink in the nozzles of the printheads. Each capping station has a receptacle, a vacuum source, a transducer, and a valve in an opening in a floor of the receptacle. A controller is operatively connected to actuators to move the receptacle so a seal on an upper wall of the receptacle engages a printhead housing. The controller also operates the valve to close the opening in the receptacle floor and then operates the vacuum source to establish a negative pressure in the volume within the receptacle. The transducer is then operated by the controller to fluctuate ink menisci in the nozzles of the printheads to prevent the ink from drying in the nozzles.

15 Claims, 6 Drawing Sheets

(56) References Cited

U.S. PATENT DOCUMENTS

| | | | | |
|---|---|---|---|---|
| 4,947,187 | A | 8/1990 | Iwagami | |
| 5,300,958 | A | 4/1994 | Burke et al. | |
| 5,394,178 | A | 2/1995 | Grange | |
| 5,412,411 | A | 5/1995 | Anderson | |
| 5,635,965 | A | 6/1997 | Purwins et al. | |
| 5,663,751 | A | 9/1997 | Holbrook | |
| 5,936,647 | A | 8/1999 | Rhodes et al. | |
| 5,949,448 | A | 9/1999 | Man et al. | |
| 5,980,622 | A | 11/1999 | Byers | |
| 6,135,585 | A | 10/2000 | Johnson et al. | |
| 6,183,057 | B1 | 2/2001 | Sharma et al. | |
| 6,196,657 | B1 | 3/2001 | Hawkins et al. | |
| 6,347,858 | B1 | 2/2002 | Faisst, Jr. et al. | |
| 6,508,533 | B2 | 1/2003 | Tsujimoto et al. | |
| 6,523,931 | B1 * | 2/2003 | Cipolla | B41J 2/16523 347/29 |
| 6,726,304 | B2 | 4/2004 | Fassler et al. | |
| 7,153,689 | B2 | 12/2006 | Tolosko et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2003/0231222 | A1 | 12/2003 | Jefferson et al. | |
| 2007/0080999 | A1 | 4/2007 | Morgan et al. | |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0147043 | A1 | 6/2009 | McAvoy | |
| 2009/0237424 | A1 | 9/2009 | Martin et al. | |
| 2009/0278885 | A1 | 11/2009 | Morgan et al. | |
| 2010/0073445 | A1 | 3/2010 | Silverbrook et al. | |
| 2013/0133200 | A1 * | 5/2013 | Murray | B41J 2/17596 29/890.1 |
| 2013/0215189 | A1 | 8/2013 | Justice et al. | |
| 2014/0060662 | A1 | 3/2014 | Dumas et al. | |
| 2016/0031222 | A1 * | 2/2016 | Kobayashi | B41J 2/16523 347/28 |
| 2016/0221343 | A1 | 8/2016 | Brewster et al. | |
| 2018/0304634 | A1 | 10/2018 | Hussain et al. | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008-026417 | A1 | 3/2008 |

* cited by examiner

SYSTEM AND METHOD FOR ATTENUATING THE DRYING OF INK FROM A PRINTHEAD DURING PERIODS OF PRINTER INACTIVITY

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 4. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to block the conduit 634 selectively. A valve 612 is also provided in the conduit 614 to connect an air pressure pump 616 to the ink reservoir 604 and this valve remains open to atmospheric pressure except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. In a prior art printer, a capping station, such as the station 60 shown in FIG. 5A and FIG. 5B, is used to cover a printhead when the printer is not in use. The cap is formed as a receptacle 704 to collect ink produced by the printhead 708 during a purge of the printhead. An actuator (not shown) is operated to move the printhead 708 into contact with an opening in the receptacle 704 as shown in FIG. 5B so the printhead can be purged to restore inkjets in the printhead by applying pressure to the ink manifold and passageways in the printhead. This pressure urges ink out of the nozzles in the faceplate of the printhead. This ink purging helps restore clogged and inoperative inkjets to their operational status. The ink purged from the printhead is directed to an exit chute 712 so the ink can reach a waste receptacle. The cap receptacle 704 also helps keep the ink in the nozzles from drying out because the printhead face is held within the enclosed space of the cap receptacle rather than being exposed to circulating ambient air.

For some quickly drying inks, however, the enclosed space of the cap is sufficient to enable the solvent, such as water, in the ink to evaporate from the ink. As the viscosity of the ink increases from this evaporation, the ink begins to adhere to the bore of the nozzles and the inkjets can become clogged even though the printhead is covered by the cap. Sometimes, the amount of ink that reaches a viscosity level can be more than a purge cycle can remove to restore the inkjet to operational status. Being able to preserve the operational status of the inkjets during a period of printhead inactivity would be beneficial.

SUMMARY

A method of inkjet printer operation enables ink at the nozzles of a printhead to maintain a low viscosity state. The method includes operating a first actuator with a controller to move in a first direction a receptacle having at least one wall and a floor that partially enclose a volume within the receptacle so a seal mounted to an upper surface of the at least one wall of the receptacle engages with a printhead housing that surrounds a printhead faceplate, operating a valve to close an opening in the floor of the receptacle, operating a vacuum source with a controller to apply a vacuum to the volume enclosed by the printhead faceplate, the at least one wall, and the floor when the seal engages the printhead housing, and operating with the controller a transducer that fluidly communicates with the volume to fluctuate ink menisci within nozzles in the printhead faceplate.

A capping station is configured to implement the method that enables ink at the nozzles of a printhead to maintain a low viscosity state. The capping station includes a receptacle having at least one wall and a floor configured to enclose a volume partially, the at least one wall of the receptacle having a first opening and the floor having an opening, a seal mounted to an upper surface of the at least one wall of the receptacle, a vacuum source operatively connected through the first opening to the volume within the receptacle, a transducer operatively connected through the first opening to the volume within the receptacle, the transducer being configured to vibrate air within the volume within the receptacle, a valve, the valve being configured to open and close the opening in the floor selectively, an actuator operatively connected to the receptacle, the actuator being configured to move the receptacle bidirectionally, and a controller operatively connected to the actuator, the valve, the transducer, and the vacuum source. The controller is configured to operate the actuator to move the receptacle in a first direction and engage the seal with a printhead housing that surrounds a printhead faceplate, operate the valve to close the opening in the floor, operate the vacuum source to apply a vacuum to the volume enclosed by the printhead faceplate, the at least one wall, and the floor when the seal engages the printhead housing, and operate the transducer to fluctuate ink menisci within a plurality of nozzles in the printhead faceplate.

An inkjet printer includes the capping station to implement the method that enables ink at the nozzles of a printhead to maintain a low viscosity state. The printer includes a plurality of printheads and a capping station for each printhead in the plurality of printheads. Each capping station includes a receptacle having at least one wall and a floor configured to enclose a volume partially, the at least one wall of the receptacle having a first opening and the floor having an opening, a seal mounted to an upper surface of the at least one wall of the receptacle, a vacuum source operatively connected through the first opening to the volume within the receptacle, a transducer operatively connected through the first opening to the volume within the receptacle, the transducer being configured to vibrate air within the volume within the receptacle, a valve, the valve being configured to open and close the opening in the floor selectively, an actuator operatively connected to the receptacle, the actuator being configured to move the receptacle bidirectionally, and a controller operatively connected to the actuator, the valve, the transducer, and the vacuum source. The controller is configured to operate the actuator to move the receptacle in a first direction and engage the seal with a printhead housing that surrounds a printhead faceplate of one printhead in the plurality of printheads, operate the valve to close the opening in the floor, operate the vacuum source to apply a vacuum to the volume enclosed by the printhead faceplate, the at least one wall, and the floor when the seal engages the printhead housing, and operate the transducer to fluctuate ink menisci within a plurality of nozzles in the printhead faceplate.

BRIEF DESCRIPTION OF THE DRAWINGS

The foregoing aspects and other features of a system and method that enable ink at the nozzles of a printhead to maintain a low viscosity state are explained in the following description, taken in connection with the accompanying drawings.

DETAILED DESCRIPTION

Figure 1A:
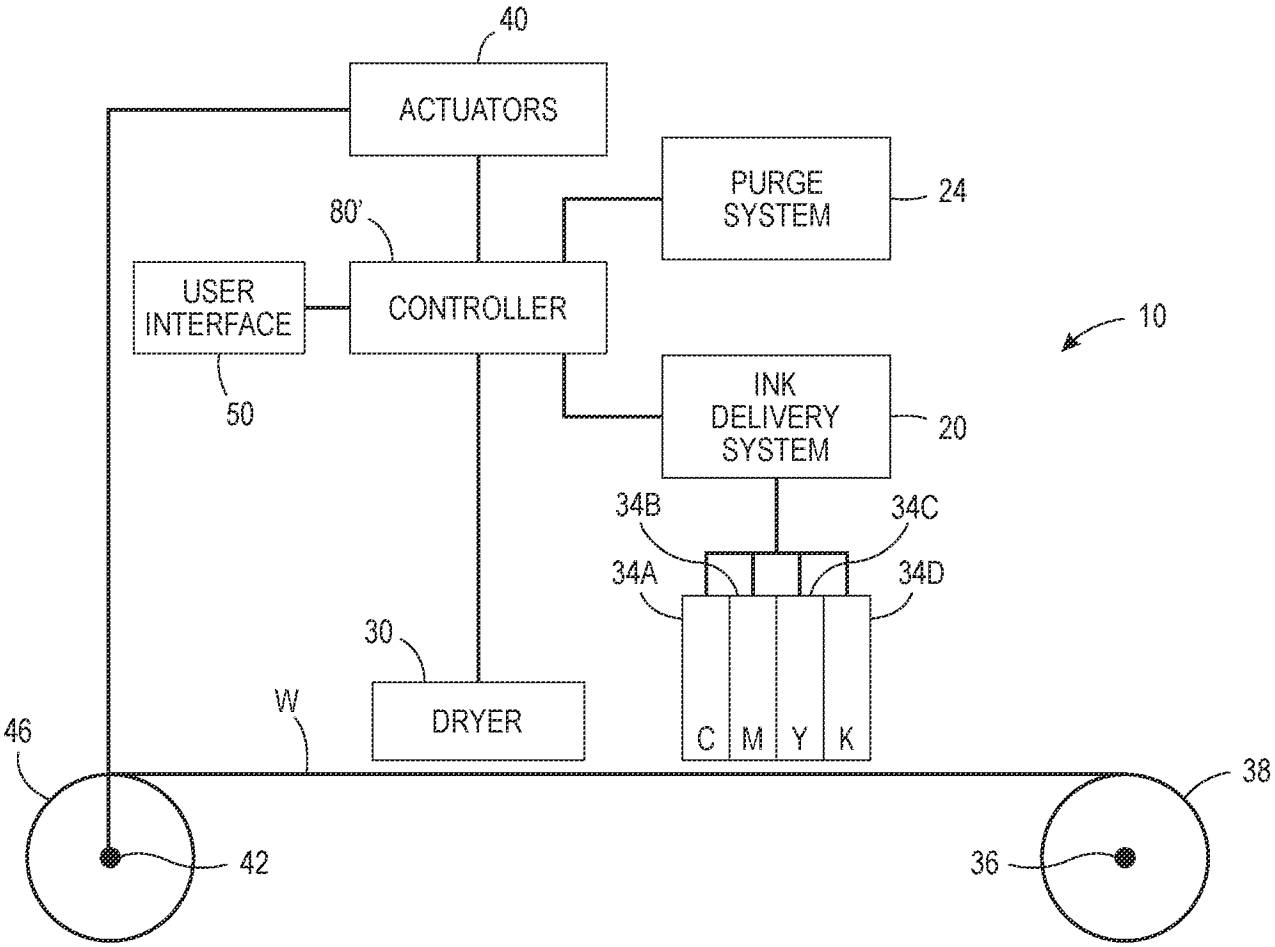
FIG. 1A is a schematic drawing of an aqueous inkjet printer that prints ink images directly to a web of media and that attenuates evaporation of fast drying inks from the printheads of the printer and FIG. 1B is a side view showing the positions of the printhead array and capping stations during printing operations.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for preserving the operational status of inkjets in an inkjet printer during periods of printer inactivity. The reader should also appreciate that the principles set forth in this description are applicable to similar imaging devices that generate images with pixels of marking material.

FIG. 1A illustrates a high-speed aqueous ink image producing machine or printer 10 in which a controller 80' has been configured to perform the process 300 described below to operate the capping system 60' (FIG. 1B) so the ink at the nozzles of the printheads 34A, 34B, 34C, and 34D maintain a low viscosity state during periods of printhead inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. Printer 10 can also be a printer that has a media transport system that replaces the moving web W to carry cut media sheets past the printheads for the printing of images on the sheets.

Figure 4:
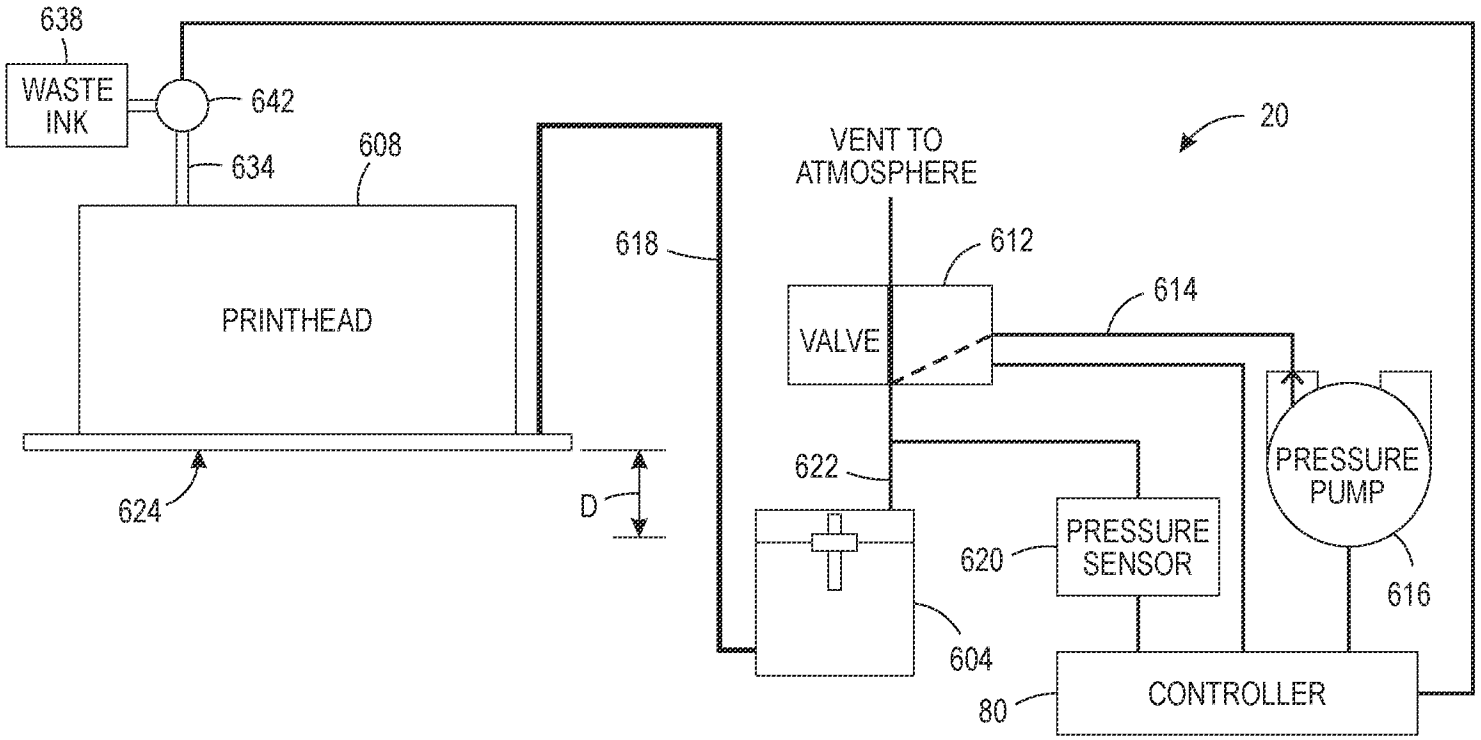
FIG. 4 PRIOR ART
FIG. 4 is a schematic diagram of a prior art ink delivery system that is used in prior art printers for purging only.

The aqueous ink delivery subsystem 20, such as the one shown in FIG. 4, has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described above, to perform manifold and inkjet purges. Additionally, although not shown in FIG. 1A and FIG. 1B, each printhead in a printhead module is connected to a corresponding waste ink tank with a valve as described previously with reference to FIG. 4 to enable the collection of purged ink during the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module. The controller 80' also operates the capping system 60' and one or more actuators 40 that are operatively connected to components in the capping system 60' to preserve the low viscosity of the ink in the nozzles of the printheads in the printhead modules as described more fully below.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80'. The ESS or controller 80' is operably connected to the components of the ink delivery system 20, the purge system 24, the printhead modules 34A-34D (and thus the printheads), the actuators 40, the heater 30, and the capping station 60'. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50 and executes such controls accordingly. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2:
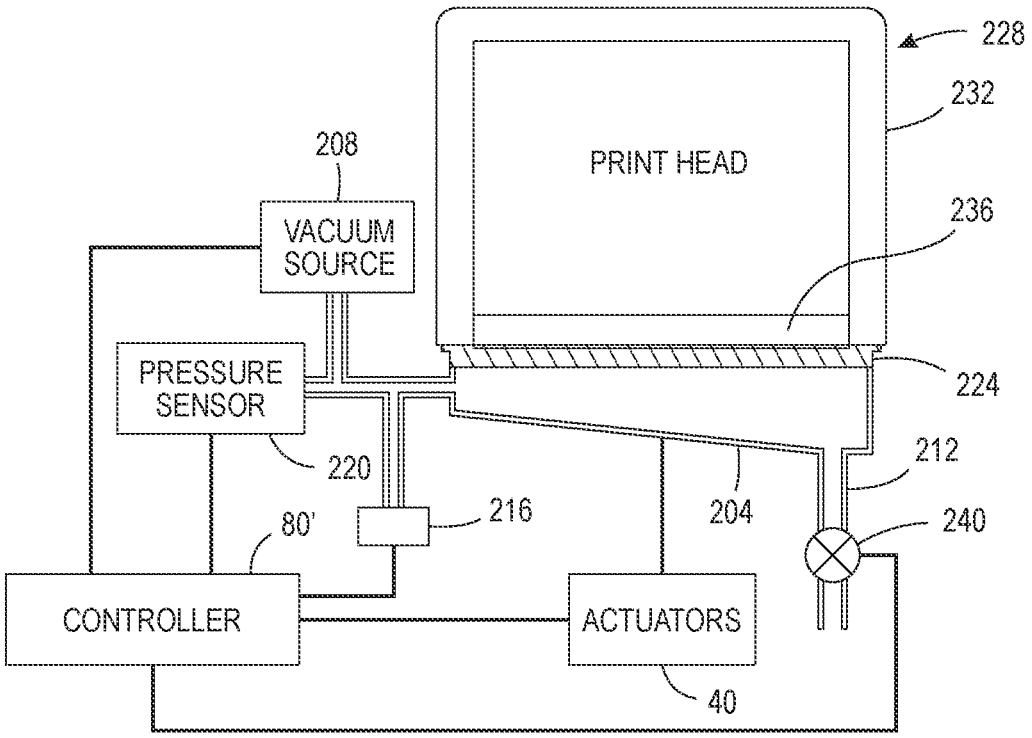
FIG. 2 is a schematic drawing of a printhead capping system used in the printer of FIG. 1A and FIG. 1B that preserves the viscosity of a fast-drying ink during a period of inactivity.

Using like numbers for like components, a capping station that can attenuate the evaporation of quickly drying inks from printheads is shown in FIG. 2. The capping station 60' includes a receptacle 204, a vacuum source 208, a fluid outlet 212, a transducer 216, a pressure sensor 220, and a perimeter seal 224. The receptacle 204 is a housing having at least one wall and a floor that partially surrounds a volume of air. A controller 80' is operatively connected to the actuators 40 to operate one of the actuators operatively connected to the receptacle 204 and the controller 80' operates the actuator to move the receptacle toward and away from the printhead. The perimeter seal 224 is mounted along the perimeter of the receptacle at an upper surface of the wall or walls forming the receptacle 204. This seal is made of an elastomeric material that hermetically seals the volume within the receptacle 204 when the controller 80' operates one of the actuators 40 to move the receptacle toward the printhead 228 until the perimeter seal contacts the printhead housing 232 and surrounds the perimeter of the nozzle faceplate 236 of the printhead 228.

Figure 1B:
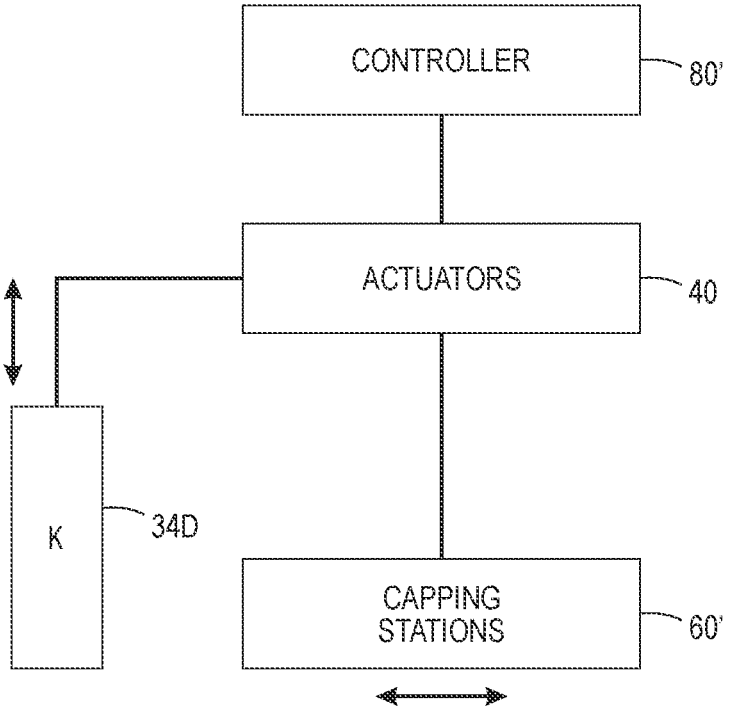

As shown in FIG. 1B, a plurality of capping stations 60' are positioned behind the printhead modules 34A, 34B, 34C, and 34D during printing operations. When one of more printheads need long term storage, the corresponding printhead is raised by the controller 80' operating one of the actuators 40 and the corresponding capping station 60' is moved opposite and underneath the raised printhead by the controller 80' operating another one of the actuators 40. The controller 80' then operates the actuators, printhead, and capping station components as described in more detail below to preserve the operational status of the printhead during a period of printhead inactivity. When the printhead is returned to operational status, the controller 80' operates the actuators 40 to lift the printhead from its capping station, return the capping station to a position behind the printhead, and lower the printhead to its printing position.

With continued reference to FIG. 2, a valve 240 is operatively positioned in the fluid outlet 212. The controller 80' is operatively connected to the valve 240 so the controller operates the valve to open and close the fluid outlet 220 from the receptacle 204. A vacuum source 244 is operatively connected to the volume within the receptacle 204 and the controller 80' so the controller can operate the vacuum source 244 to apply a vacuum to the volume within the receptacle 204 selectively. The pressure sensor 220 fluidly communicates with the volume within the receptacle 204. The pressure sensor 220 is configured to generate a signal indicative of the pressure in the volume of the receptacle 204 when the seal 224 has hermetically sealed the volume. The transducer 216 has an interface that fluidly communicates with the volume in the receptacle. The controller 80' is operatively connected to the transducer so the controller can operate the transducer selectively. The transducer 216 is configured to vibrate the interface with the receptacle volume to cause the pressure within the receptacle to fluctuate. This fluctuation causes the ink menisci in the nozzles of the faceplate 236 to vibrate. This vibration keeps the ink in the nozzles from drying so the printhead retains its operational status. In one embodiment, the transducer can be a piezoelectric transducer. The floor of the receptacle 204 slopes toward the fluid outlet 212 to facilitate the migration of any ink that falls from the faceplate 236 toward the fluid outlet and out of the receptacle.

Figure 3:
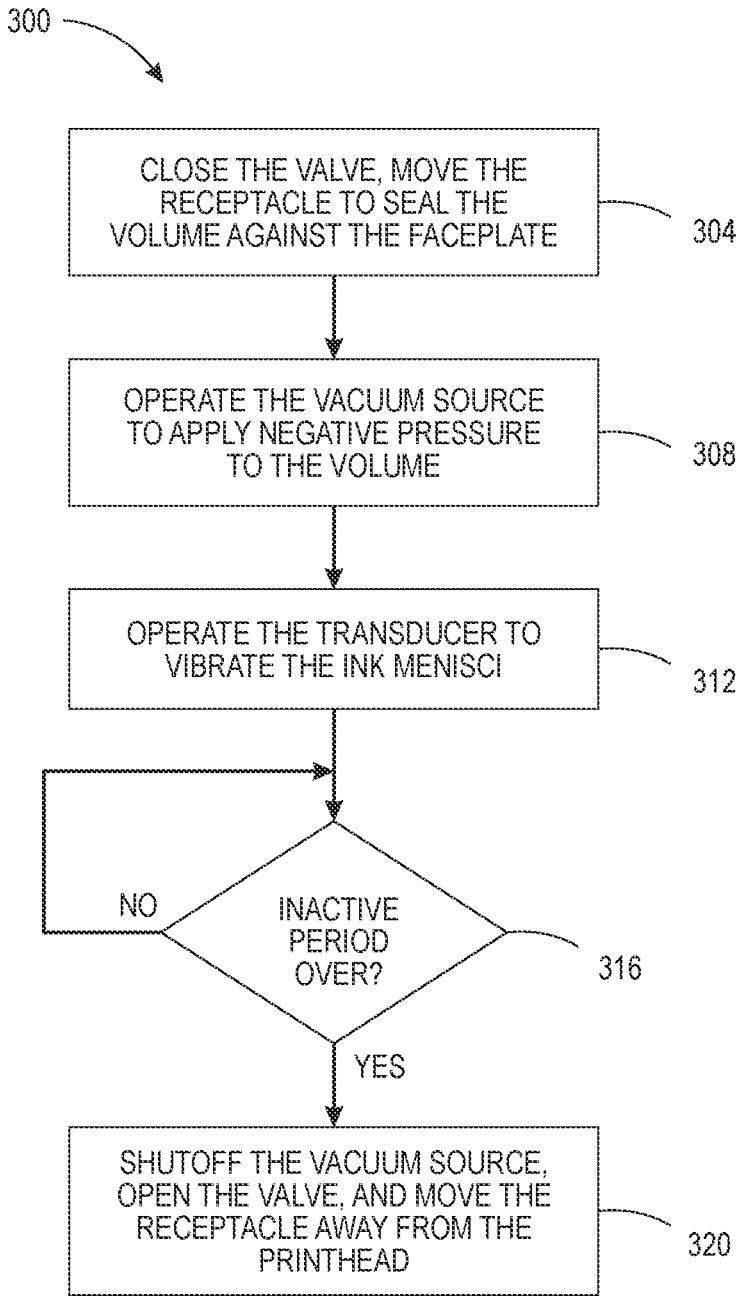
FIG. 3 is a flow diagram of a process for capping a printhead in the printer of FIG. 1 so evaporation of fast drying inks from the printheads of the printers is reduced.
Figure 5A:
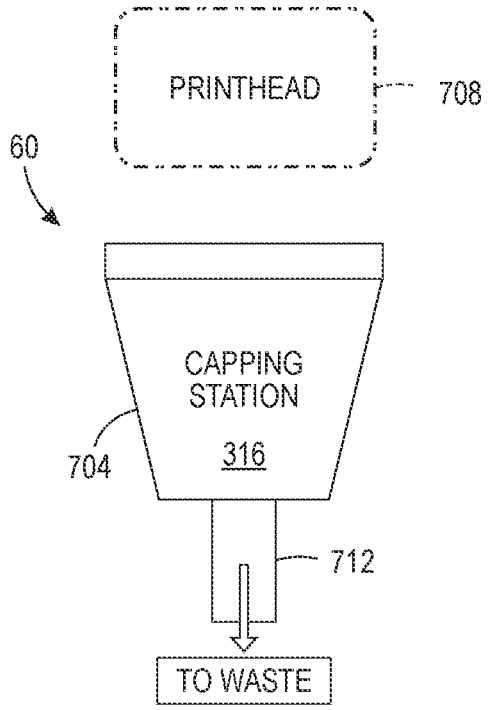
FIG. 5A PRIOR ART
FIG. 5A and FIG. 5B are schematic diagrams of a prior art capping station.
Figure 5B:
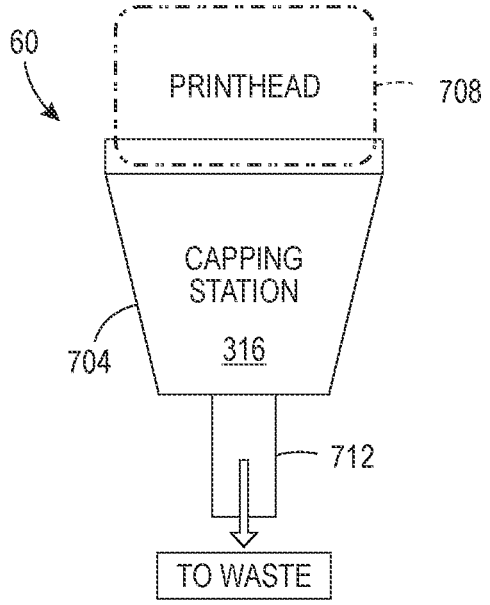
FIG. 5B PRIOR ART

The capping station 60' shown in FIG. 2 differs from the one shown in FIG. 5A and FIG. 5B in that controller 80' is configured to perform the process 300 shown in FIG. 3 between print jobs or other periods of printhead inactivity to operate the capping station to reduce ink drying at the nozzles of the printhead 228 in one of the modules 34A, 34B, 34C, and 34D. FIG. 3 depicts a flow diagram for the process 300 that operates the capping system 60' to seal the volume within the receptacle against the faceplate of the printhead so a vacuum can be applied to the nozzles in the faceplate with the vacuum source 244 and then the transducer 216 is operated to fluctuate the ink in the nozzles of the faceplate. In the discussion below, a reference to the process 300 performing a function or action refers to the operation of a controller, such as controller 80', to execute stored program instructions to perform the function or action in association with other components in the printer. The process 300 is described as being performed with capping station 60' in the printer 10 of FIG. 1A and FIG. 1B for illustrative purposes.

The process 300 for operating the capping station 60' is now discussed with reference to FIG. 3. When the printhead is to be capped for a relatively long period of printer inactivity, the controller 80' operates one or more actuators to move the printhead opposite the capping station 60'. The controller 80' then closes the valve 240 and operates one of the actuators 40 to move the receptacle 204 toward the printhead 228 until the seal 224 engages the printhead housing 232 and hermetically seals the volume within the receptacle against the nozzle faceplate 236 (block 304). Once the volume between the nozzle faceplate and the planar member is sealed, the controller 80' operates the vacuum source 244 to apply a negative pressure to the volume within the receptacle 204 (block 308). This vacuum action pulls the ink menisci within the nozzles of the faceplate toward the nozzle openings on the faceplate. In one embodiment, this negative pressure is 125 Pa. The controller 80' monitors the signal from the pressure sensor and compares it to a predetermined threshold to determine when the appropriate vacuum has been achieved. Once the vacuum is established, the controller 80' operates the transducer 216 to vibrate the air within the receptacle 204 and vibrate the ink menisci within the nozzles (block 312). This vibration of the ink menisci with the transducer operation continues until the period of printhead inactivity is completed (block 316). At that time, the controller 80' deactivates the vacuum source, operates the valve 240 to open the fluid outlet 212, and operates one of the actuators to pull the perimeter seal away from the printhead housing (block 320). Any ink pulled from the faceplate can then flow through the fluid outlet 212 to a waste tank or reservoir (not shown).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A capping station for storing printheads during periods of printhead inactivity comprising:

a receptacle having at least one wall and a floor configured to enclose a volume partially, the at least one wall of the receptacle having a first opening and the floor having an opening;

a seal mounted to an upper surface of the at least one wall of the receptacle;

a vacuum source operatively connected through the first opening to the volume within the receptacle;

a transducer operatively connected through the first opening to the volume within the receptacle, the transducer being configured to vibrate air within the volume within the receptacle;

a valve, the valve being configured to open and close the opening in the floor selectively;

an actuator operatively connected to the receptacle, the actuator being configured to move the receptacle bidirectionally; and a controller operatively connected to the actuator, the valve, the transducer, and the vacuum source, the controller being configured to operate the actuator to move the receptacle in a first direction and engage the seal with a printhead housing that surrounds a printhead faceplate, operate the valve to close the opening in the floor, operate the vacuum source to apply a vacuum to the volume enclosed by the printhead faceplate, the at least one wall, and the floor when the seal engages the printhead housing, and operate the transducer to fluctuate ink menisci within a plurality of nozzles in the printhead faceplate.

2. The capping station of claim 1 further comprising:

a pressure sensor that fluidly communicates with the volume within the receptacle, the pressure sensor being configured to generate a signal indicative of a pressure within the volume in the receptacle; and the controller being operatively connected to the pressure sensor, the controller being further configured to compare the signal generated by the pressure sensor to a predetermined threshold to determine a predetermined pressure is reached in the volume before operating the transducer.

3. The capping station of claim 2, the controller being further configured to:

operate the actuator to move the receptacle in a direction opposite the first direction to separate the seal from the printhead housing and operate the valve to open the opening in the floor so ink falling from the nozzles in the printhead faceplate exit the receptacle through the opening in the floor.

4. The capping station of claim 2 wherein the seal is comprised essentially of an elastomeric material.

5. The capping station of claim 2 wherein the floor of the receptacle slopes toward the opening in the floor.

6. The capping station of claim 2 wherein the transducer is a piezoelectric transducer.

7. A method for operating a capping station to store printheads during periods of printhead inactivity comprising:

operating a first actuator with a controller to move in a first direction a receptacle having at least one wall and a floor that partially enclose a volume within the receptacle so a seal mounted to an upper surface of the at least one wall of the receptacle engages with a printhead housing that surrounds a printhead faceplate;

operating a valve to close an opening in the floor of the receptacle;

operating a vacuum source with a controller to apply a vacuum to the volume enclosed by the printhead faceplate, the at least one wall, and the floor when the seal engages the printhead housing; and operating with the controller a transducer that fluidly communicates with the volume to fluctuate ink menisci within nozzles in the printhead faceplate.

8. The method of claim 7 further comprising:

generating with a pressure sensor a signal indicative of a pressure within the volume; and comparing with the controller the signal generated by the pressure sensor to a predetermined threshold to determine a predetermined pressure is reached in the volume before operating the transducer.

9. The method of claim 8 further comprising:

operating the actuator with the controller to move the receptacle in a direction opposite the first direction to separate the seal from the printhead housing; and operating the valve to open the opening in the floor so ink falling from the nozzles in the printhead faceplate exit the receptacle through the opening in the floor.

10. A printer comprising:

a plurality of printheads;

a capping station for each printhead in the plurality of printheads, each capping station including:

a receptacle having at least one wall and a floor configured to enclose a volume partially, the at least one wall of the receptacle having a first opening and the floor having an opening;

a seal mounted to an upper surface of the at least one wall of the receptacle;

a vacuum source operatively connected through the first opening to the volume within the receptacle;

a transducer operatively connected through the first opening to the volume within the receptacle, the transducer being configured to vibrate air within the volume within the receptacle;

a valve, the valve being configured to open and close the opening in the floor selectively;

an actuator operatively connected to the receptacle, the actuator being configured to move the receptacle bidirectionally; and a controller operatively connected to the actuator, the valve, the transducer, and the vacuum source, the controller being configured to operate the actuator to move the receptacle in a first direction and engage the seal with a printhead housing that surrounds a printhead faceplate of one printhead in the plurality of printheads, operate the valve to close the opening in the floor, operate the vacuum source to apply a vacuum to the volume enclosed by the printhead faceplate, the at least one wall, and the floor when the seal engages the printhead housing, and operate the transducer to fluctuate ink menisci within a plurality of nozzles in the printhead faceplate.

11. The printer of claim 10 further comprising:

a pressure sensor that fluidly communicates with the volume within the receptacle, the pressure sensor being configured to generate a signal indicative of a pressure within the volume in the receptacle; and the controller being operatively connected to the pressure sensor, the controller being further configured to compare the signal generated by the pressure sensor to a predetermined threshold to determine a predetermined pressure is reached in the volume before operating the transducer.

12. The printer of claim 10, the controller being further configured to:

operate the actuator to move the receptacle in a direction opposite the first direction to separate the seal from the printhead housing and operate the valve to open the opening in the floor so ink falling from the nozzles in the printhead faceplate exit the receptacle through the opening in the floor.

13. The printer of claim 10 wherein the seal is comprised essentially of an elastomeric material.

14. The printer of claim 10 wherein the floor of the receptacle slopes toward the opening in the floor.

15. The printer of claim 10 wherein the transducer is a piezoelectric transducer.

* * * * *